US007073357B2

(12) United States Patent
Nixon, Jr.

(10) Patent No.: US 7,073,357 B2
(45) Date of Patent: Jul. 11, 2006

(54) HANDLE LOCK

(76) Inventor: Willie E. Nixon, Jr., 8545 Old State Rd. 37N, Martinsville, IN (US) 46151

( * ) Notice: Subject to any disclaimer, the term of this patent is extended or adjusted under 35 U.S.C. 154(b) by 232 days.

(21) Appl. No.: 10/840,782

(22) Filed: May 6, 2004

(65) Prior Publication Data

US 2005/0247086 A1 Nov. 10, 2005

(51) Int. Cl.
*E05B 67/38* (2006.01)

(52) U.S. Cl. ..... 70/56; 70/211; 70/201; 292/DIG. 32; 292/218

(58) Field of Classification Search ..... 70/54–56, 70/201–203, 210–212; 292/DIG. 32, 218, 292/259 R, 341.15, 341.16
See application file for complete search history.

(56) References Cited

U.S. PATENT DOCUMENTS 4,082,330 A * 4/1978 McWhorter ..... 292/218
4,413,492 A * 11/1983 Strange ..... 70/416
4,742,701 A * 5/1988 Scavetto ..... 70/121
5,029,909 A * 7/1991 Bunger ..... 292/40
5,035,127 A * 7/1991 Larsen ..... 70/56
5,154,458 A * 10/1992 Cook et al. ..... 292/218
5,168,258 A * 12/1992 Radke ..... 340/542
5,388,435 A * 2/1995 Bailey ..... 70/101
5,507,539 A * 4/1996 Basinski ..... 292/92
5,509,700 A * 4/1996 Kennedy, Jr. ..... 292/3
5,857,721 A * 1/1999 Liroff ..... 292/307 R
6,065,314 A * 5/2000 Nicholson ..... 70/212
2005/0144991 A1 * 7/2005 Bravo et al. ..... 70/56

OTHER PUBLICATIONS

Photo-image of a handle lock for a trailer door (1 page) (before May 6, 2004).
Kaba Mas Corporation Product Information (5 pages) (before May 6, 2004).
Babaco Alarm Systems, Inc. Product Information (1 page) (before May 6, 2004).
Transport Security, Inc. Product Information (6 pages) (before May 6, 2004).
Information about keypad from Security Door Controls (5 pages) (before May 6, 2004).
Information about electric bolt locks from Security Door Controls (9 pages) (before May 6, 2004).

* cited by examiner

*Primary Examiner*—Suzanne Dino Barrett
(74) *Attorney, Agent, or Firm*—Barnes & Thornburg LLP

(57) ABSTRACT

A handle lock is configured for use with a trailer door latch handle. The handle lock is configured to be coupled to the trailer door. The handle lock is used to lock the handle to lock the trailer door in a closed position and to unlock the handle to allow unlatching and opening of the trailer door.

20 Claims, 8 Drawing Sheets

HANDLE LOCK

BACKGROUND

The present disclosure relates to a lock. More particularly, the present disclosure relates to a handle lock for locking a trailer door latch handle.

SUMMARY

A handle lock is disclosed for use with a trailer door latch handle to lock and unlock the handle. A housing of the handle lock comprises a one-piece body (e.g., one-piece metal casting) and a back plate. The body is configured to be mounted in a through-hole formed in the door for access in front of the door. The back plate is coupled to the body to engage a rear surface of the door to block withdrawal of the body from the door.

The handle lock comprises a hasp, a pin, a bolt, and a bolt actuator. The hasp is coupled to the body for rotation relative to the body. The pin is extendable through the hasp into the body to block rotation of the hasp. The bolt and the bolt actuator are positioned in the body.

The bolt actuator moves the bolt between a lock position and an unlock position. In the lock position, the bolt blocks withdrawal of the pin from the body so that engagement between the pin and the hasp blocks rotation of the hasp to lock the handle in a handle space located between the hasp and the body for locking the door in a latched and closed position. In the unlock position, the bolt is disengaged from the pin allowing withdrawal of the pin from the body so that the hasp can be rotated to allow withdrawal of the handle from the handle space and unlatching of the door.

A controller is used to control operation of the bolt actuator and thus movement of the bolt. The controller is electrically coupled to the bolt actuator and is configured to be mounted to the trailer door. The controller comprises a user input device (e.g., a keypad) for receiving an input from a user. The controller is programmable to control operation of the bolt actuator in response to a predetermined code entered through the user input device.

Additional features of the disclosure will become apparent to those skilled in the art upon consideration of the following description exemplifying the best mode of carrying out the disclosure as presently perceived.

BRIEF DESCRIPTION OF THE DRAWINGS

The detailed description particularly refers to the following figures in which.

DETAILED DESCRIPTION

Figure 5:
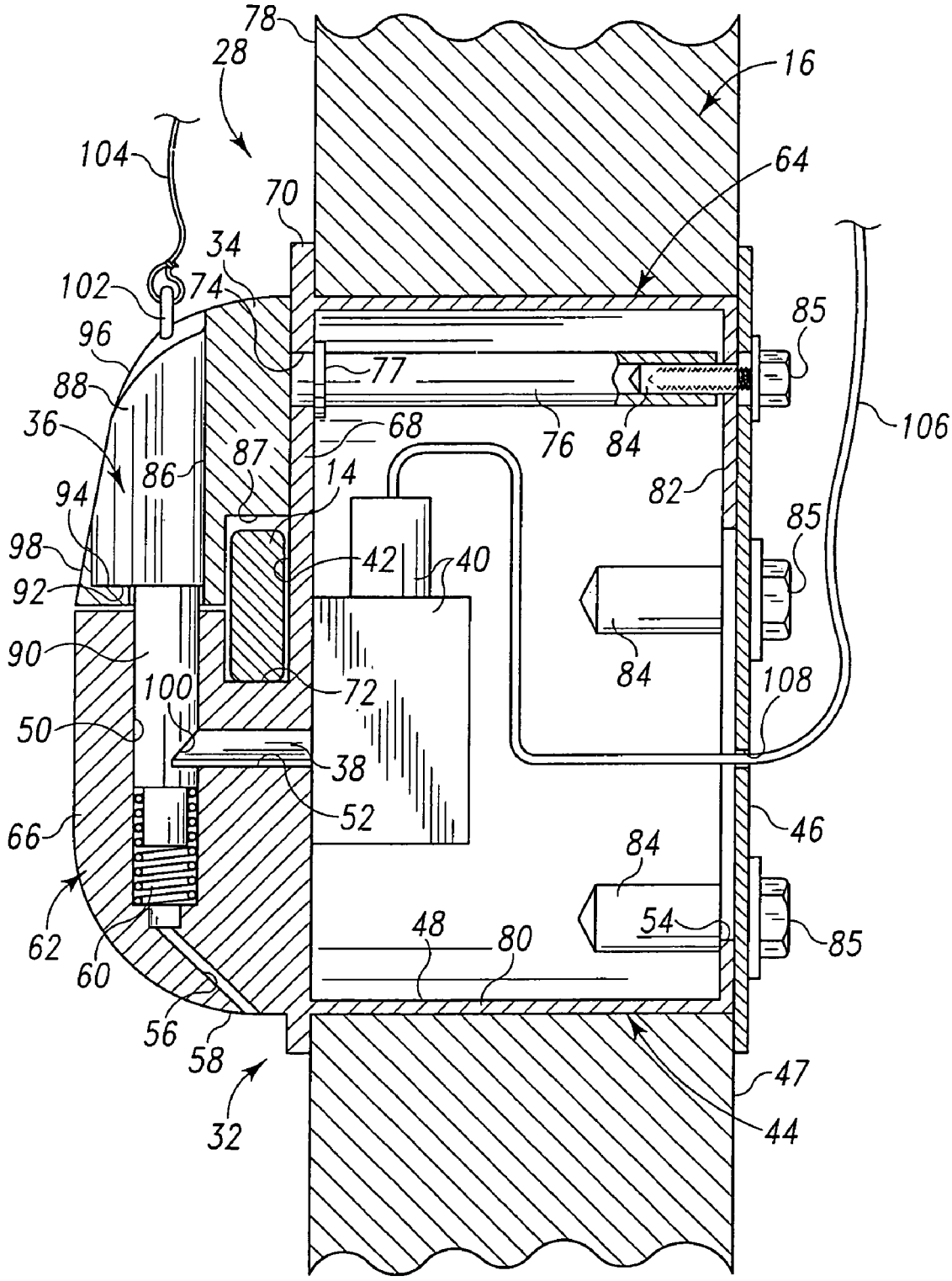
FIG. 5 is a sectional view taken along lines 5—5 of FIG. 3 showing the handle lock locking the handle.
Figure 6:
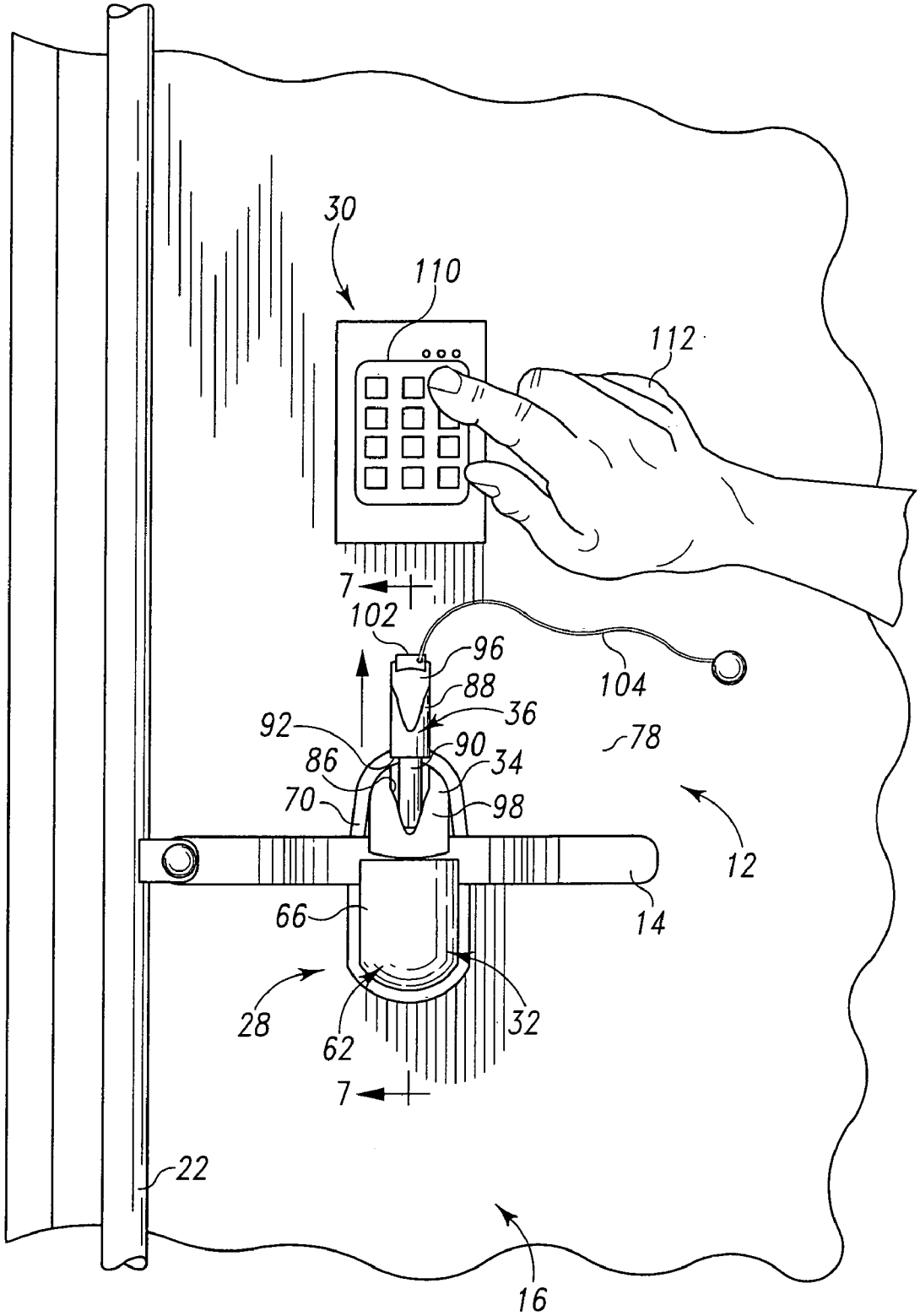
FIG. 6 is a front elevation view showing unlocking of the handle lock in response to input of a predetermined code into a controller of the handle lock.
Figure 7:
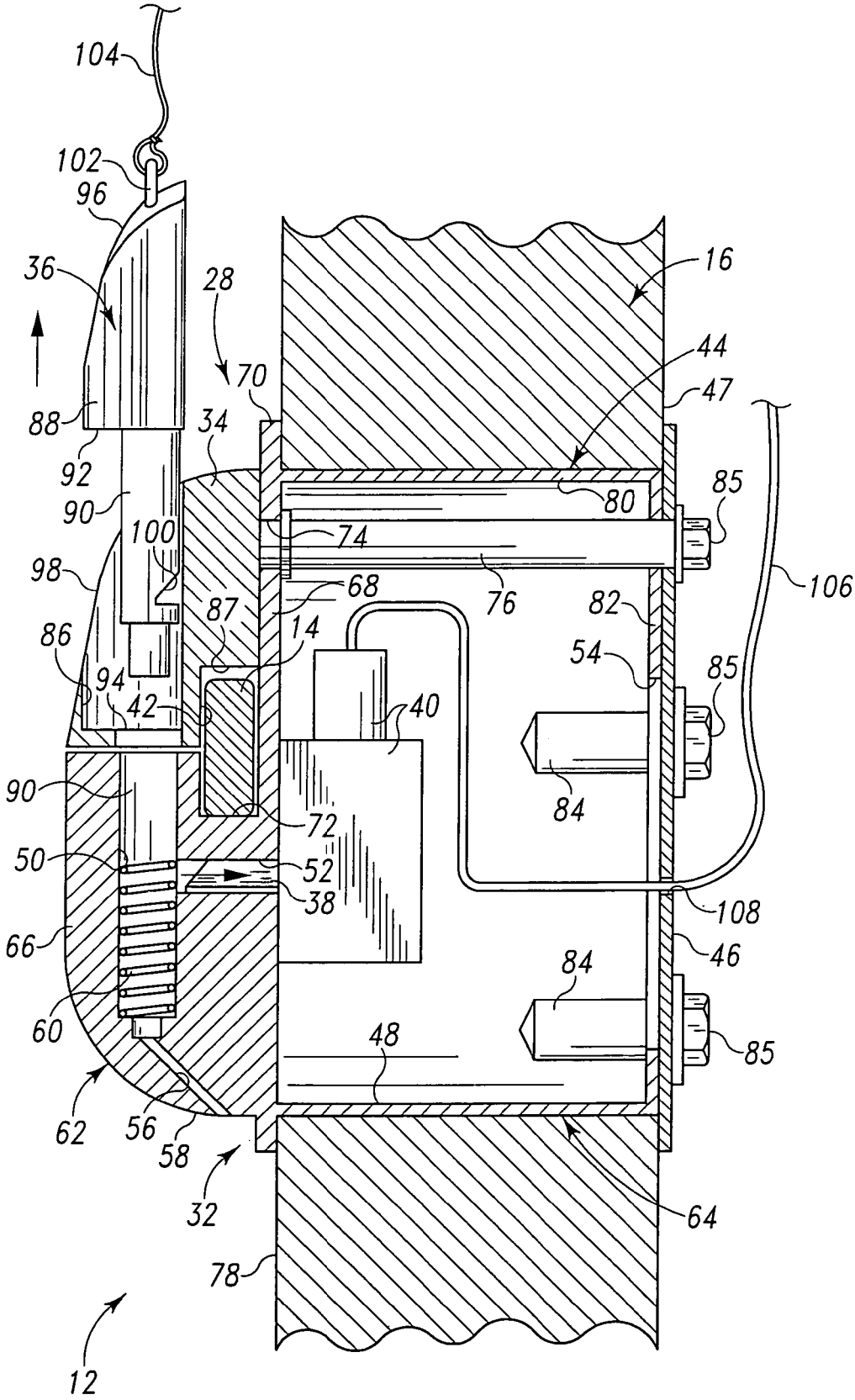
FIG. 7 is a sectional view taken along lines 7—7 of FIG. 6 showing the handle lock unlocking the handle.
Figure 8:
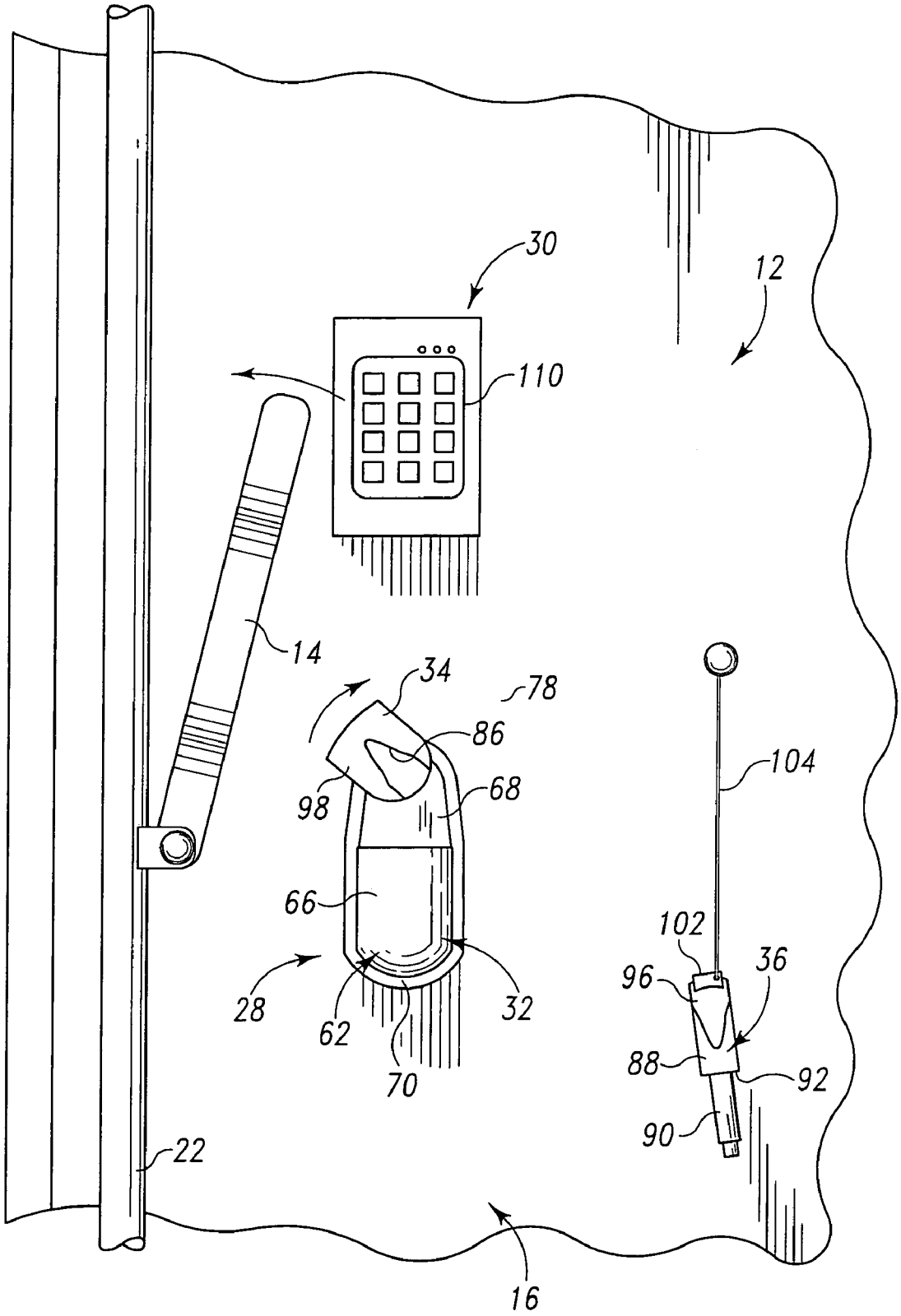
FIG. 8 is a front elevation view showing movement of the handle away from the handle lock upon unlocking of the handle lock.

An apparatus 10 comprises a handle lock 12 for locking a trailer door latch handle 14, as shown, for example, in FIGS. 1–3 and 5, and for unlocking handle 14, as shown, for example, in FIGS. 6–8. Handle lock 12 locks handle 14 to lock a door 16 of a trailer 18 in a closed position (see FIG. 1) and unlocks handle 14 to allow opening of door 16.

Figure 1:
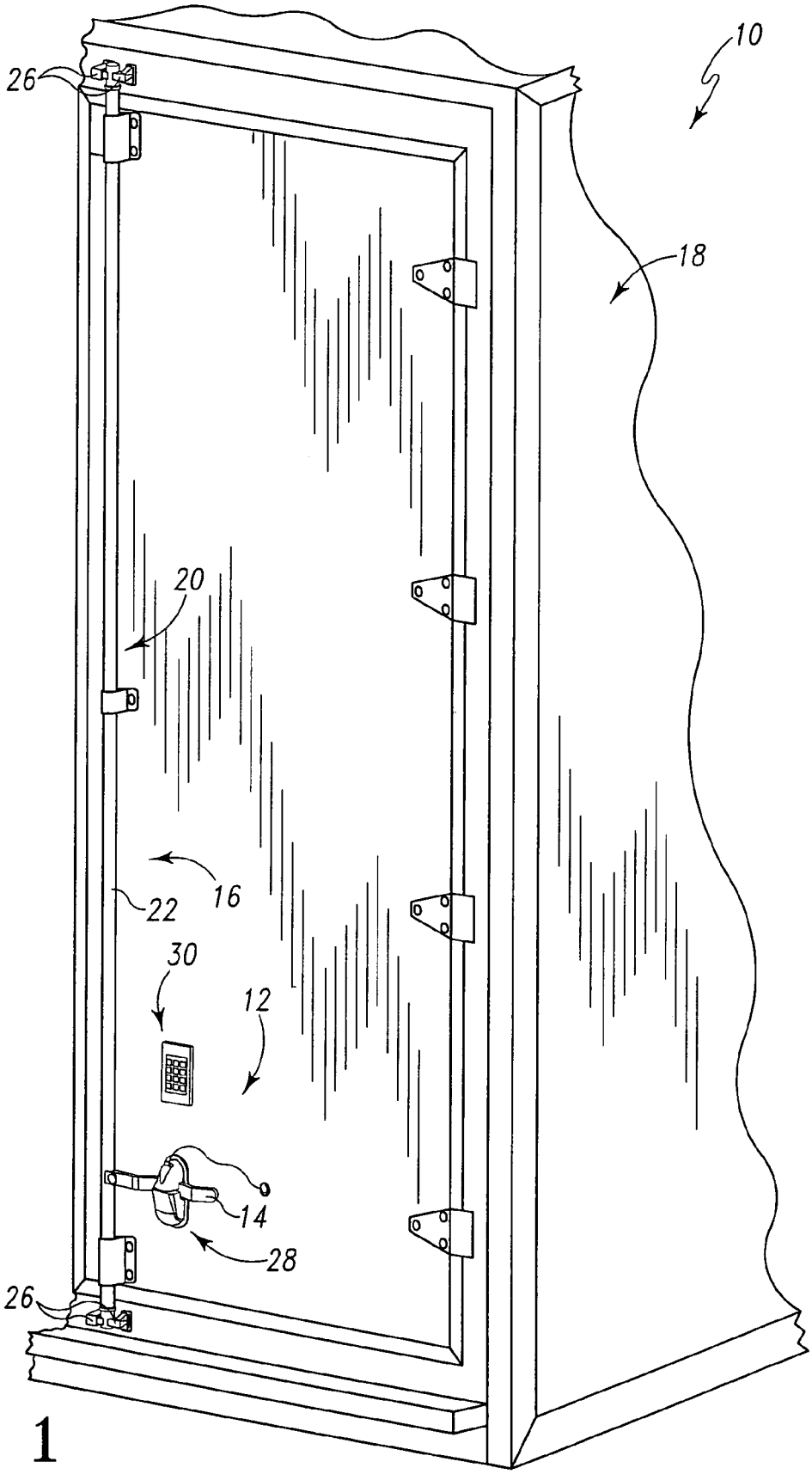
FIG. 1 is a perspective view showing locking of a trailer door latch handle by use of a handle lock coupled to the trailer door.
Figure 3:
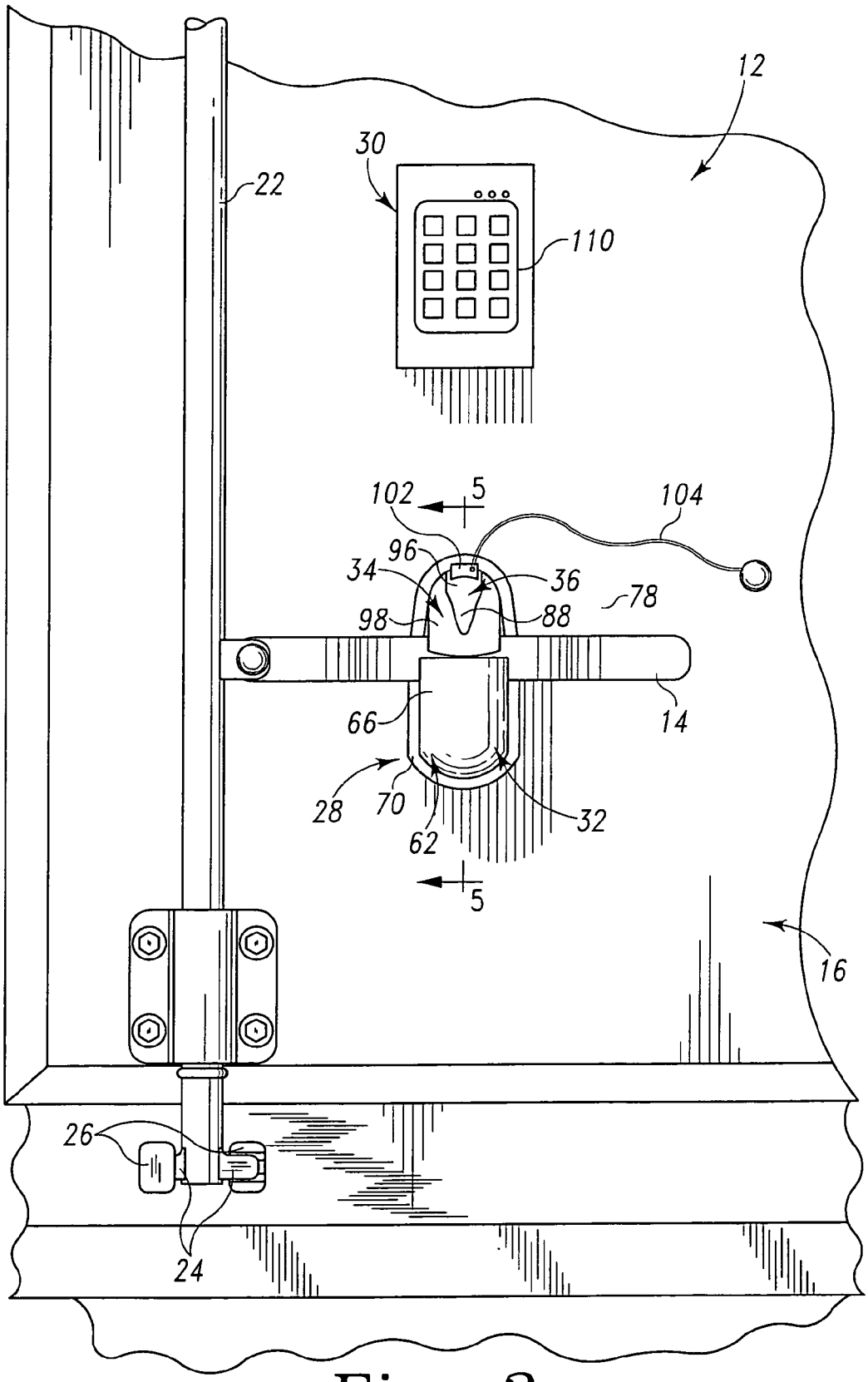
FIG. 3 is a front elevation view of the handle lock.
Figure 4:
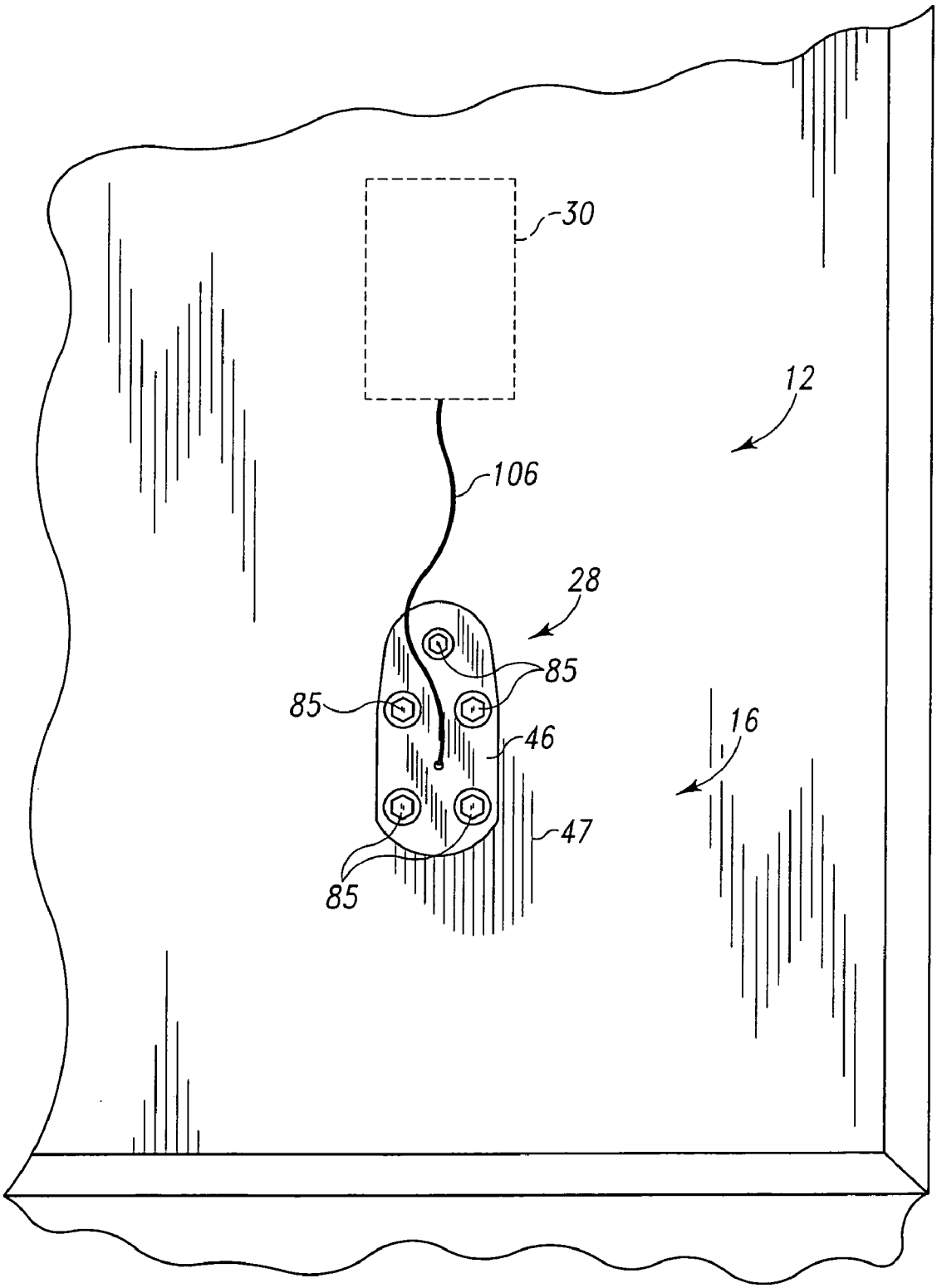
FIG. 4 is a rear elevation view of the handle lock.

Handle 14 is a component of a conventional door latch 20 shown, for example, in FIGS. 1 and 3. Door latch 20 comprises a pole 22 rotatably coupled to door 16 to rotate lugs 24 coupled to opposite ends of pole 22 for engagement with lug retainers 24 to latch door 16 and for disengagement with lug retainers 24 to unlatch door 16. Handle 14 is coupled to pole 22 for rotation of pole 22 and lugs 24 and is coupled to pole 22 for rotation of handle 14 for locking and unlocking of handle 14 by handle lock 12.

Handle lock 12 comprises a handle retainer 28 for retaining handle 12 and an electronic controller 30 for electrically controlling handle retainer 28, as shown, for example, in FIGS. 1, 3, 6, and 8. Handle retainer 28 and controller 30 are coupled to door 16 for movement therewith between its closed and opened positions.

Figure 2:
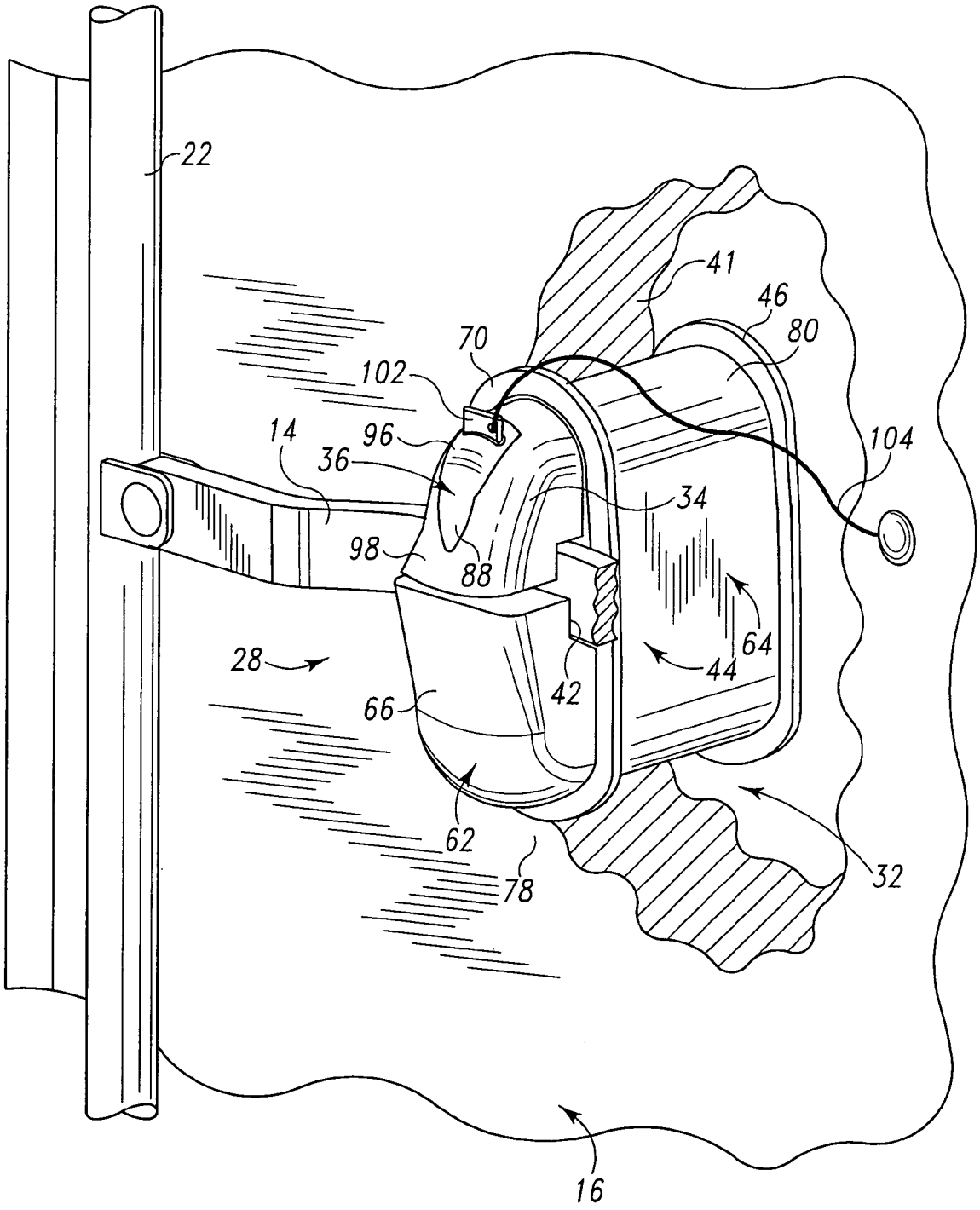
FIG. 2 is an enlarged perspective view showing components of the handle lock mounted in the trailer door.

Handle retainer 28 comprises a housing 32, a rotatable hasp 34, a pin 36, a bolt 38, and a bolt actuator 40, as shown, for example, in FIGS. 2 and 5. Housing 32 is configured to be mounted in and extend through a through-hole 41 formed in door 16. Hasp 34 is rotatable to selectively retain handle 14 in a handle space 42 located between hasp 34 and housing 32 and release handle 14. Pin 36 is extendable through hasp 34 into housing 32 to block rotation of hasp 34 to retain handle 14 in handle space 42. Bolt 38 and bolt actuator 40 are positioned in housing 32. Bolt actuator 40 is responsive to commands from controller 30 to move bolt 38 between a lock position and an unlock position. In the lock position, bolt 38 blocks withdrawal of pin 36 from housing 32 so that pin 36 blocks rotation of hasp to lock handle 14 in handle space 42 for locking door 16 in the latched and closed position. In the unlock position, bolt 38 allows withdrawal of pin 36 from housing 32 so that hasp 34 can be rotated to allow withdrawal of handle 14 of handle 14 from handle space 42 and unlatching and opening of door 16.

Housing 32 comprises a one-piece body 44 and a back plate 46 coupled thereto, as shown, for example, in FIGS. 2, 5, and 7. The one-piece configuration of body 44 inhibits external accessibility to bolt 38, bolt actuator 40, and the connection between pin 36 and bolt 38. To further inhibit such external accessibility, in some embodiments body 44 is a metal casting made of, for example, stainless steel. Back plate 46 engages a rear surface 47 of door 16 to block withdrawal of body 44 from hole 41.

Body 44 comprises an actuator chamber 48, a pin channel 50, and a bolt channel 52, as shown, for example, in FIGS. 5 and 7. Bolt actuator 40 is positioned in actuator chamber 48. Pin channel 50 is provided for receiving pin 36. Bolt channel 52 interconnects actuator chamber 48 and pin channel 52 for movement of bolt 38 between the lock and unlock positions. A rear access opening 54 is formed in body 44 for insertion therethrough of bolt actuator 40 and bolt 38 into actuator chamber 48 and bolt channel 52, respectively. A drain channel 56 extends from pin channel 50 to an external surface 58 of body 44 to drain fluid that may enter pin channel 50 from time to time. A spring 60 is positioned in pin channel 50 for at least partially ejecting pin 36 from pin channel 50 when bolt 38 releases pin 36 due to movement of bolt 38 from the lock position to the unlock position.

Body 44 comprises a forward portion 62 and an intermediate portion 64, as shown, for example, in FIGS. 2, 5, and 7. Forward portion 62 is positioned in front of door 16 and bolt 38 and bolt actuator 40 are coupled to forward portion 62. Intermediate portion 64 is positioned in hole 41 between forward portion 62 and back plate 46.

Forward portion 62 comprises a lower portion 66, a wall 68, and a retainer 70, as shown, for example, in FIGS. 5 and 7. Lower portion 66 is formed to include pin channel 50, bolt channel 52, and drain channel 56 and underlies hasp 34. Lower portion 66 comprises external surface 58 which provides lower portion 66 with a curved external contour for minimizing the effect of possible impacts to lower portion 66 by a potential intruder, thereby promoting the security of trailer 18. Wall 68 extends upwardly from lower portion 66 and cooperates with lower portion 66 to define a recess 72 therebetween for receiving handle 14. Wall 68 is formed to include a mount opening 74 through which extends a hasp mount 76 coupled to hasp 34. Retainer 70 engages a front surface 78 of door 16 to block withdrawal of body 44 from hole 41 and is configured, for example, as a retainer flange that extends outwardly around lower portion 66 and wall 68.

Intermediate portion 64 comprises a sleeve 80, a wall 82, and a plurality of fastener receivers 84, as shown, for example, in FIGS. 5 and 7. Sleeve 80 extends between and is coupled to forward portion 62 and wall 82. Sleeve 80 is positioned in hole 41 and actuator chamber 48 is formed in sleeve 80. Back plate 46 extends outwardly beyond sleeve 80 and engages a rear surface 86 of door 16 to block withdrawal of body 44 from hole 41. Wall 82 extends inwardly from sleeve 80 and is formed to include rear access opening 54. Fastener receivers 84 are coupled to wall 82 and configured to receive fasteners 85 that extend through back plate 46 into receivers 84 to couple back plate 46 to body 44.

Hasp mount 76 is configured, for example, as a sleeve that is formed as one piece with hasp 34 and mounts on the top fastener receiver 84 for rotation thereon in response to rotation of hasp 34. A retainer clip 77 is positioned in an annular groove (not shown) formed in hasp mount 76 for engagement with wall 68 to block withdrawal of hasp mount 76 through mount opening 74.

Hasp 34 comprises a pin channel 86, as shown, for example, in FIGS. 5 and 7. Pin 36 is configured to extend through pin channel 86 into pin channel 50 to block hasp 34 from rotation. Hasp 34 further comprises a recess 87 for receiving handle 14.

Pin 36 comprises a head 88 and a shaft 90, as shown, for example, in FIGS. 5 and 7. Head 88 comprises a shoulder 92 for engaging an abutment surface 94 of hasp 34 upon insertion of pin 36 into pin channel 86. Head 88 comprises a curved external surface 96 which provides head 88 with a curved external contour. Hasp 34 comprises a curved external surface 96 which provides hasp 34 with a curved external contour that matches the curved external contour of surface 96 when pin 36 is locked in pin channels 50, 86 by bolt 38. Such matching of the curved external contours provided by surfaces 96, 98 cooperate to limit access to pin 36 and to minimize the effect of possible impacts to pin hasp 34 and pin 36 by a potential intruder, thereby promoting the security of trailer 18. Shaft 90 comprises a notch 100 for receiving bolt 38 when bolt 38 assumes the lock position.

A pull tab 102 is coupled to external surface 96 of head 88, as shown, for example, in FIGS. 6 and 7. Pull tab 102 is used to withdraw pin 36 from pin channels 50, 86. In some embodiments, a tether 104 is coupled to pull tab 102 and door 16 to retain pin 36 upon withdrawal of pin 36 from channels 50, 86. In some embodiments, a pin retainer (not shown) is coupled to the end of shaft 90 to engage hasp 34 to block withdrawal of shaft 90 from pin channel 86 formed in hasp 34 so that pin 36 remains connected to hasp 34 even after shaft 90 has been withdrawn from pin channel 50 formed in body 44. Such a pin retainer may be, for example, a disk or other enlarged shaft portion having a diameter or other dimension greater than the diameter of shaft 90.

Bolt actuator 40 is configured, for example, as a solenoid actuator. In some embodiments, bolt 38 and bolt actuator 40 cooperate to form a unit such as model number 1190A available from Security Door Controls of Westlake Village, Calif. Wiring 106 extends from actuator 40 through rear access opening 54 and a wiring opening 108 formed in back plate 46 to controller 30.

Controller 30 is electrically coupled to bolt actuator 40 to control operation of bolt actuator 40 and thus movement of bolt 38. Controller 30 is coupled to the electrical system of trailer 18 to receive electrical power therefrom.

Controller 30 comprises a user input device 110, as shown, for example, in FIG. 6. User input device 110 is configured, for example, as a keypad with a number of keys to input codes and/or other data into controller 30.

Controller 30 is programmed to send an output signal to actuator 40 over wiring 106 in response to a predetermined input into input device 110. The predetermined input is, for example, a predetermined code stored in a memory of controller 30. Thus, if a user 112 inputs the correct code into input device 110, as suggested, for example, in FIG. 6, instructions stored in the memory will cause a processor (e.g., a microprocessor) of controller 30 to generate the output signal. The output signal will then cause actuator 40 to move bolt 38 between the lock position and the unlock position. In some embodiments, bolt 38 is normally spring-biased to the unlock position and the output signal causes bolt 38 to move from the unlock position to the lock position. In some embodiments, bolt 38 is normally spring-biased to the lock position and the output signal causes bolt 38 to move from the lock position to the unlock position. The code stored in the memory may be changed from time to time.

In use, handle lock 12 is used to lock handle 14 in handle space 42 to lock door 16 in place when it is latched and closed, as shown, for example, in FIGS. 1–3 and 5. To lock handle 14 in handle space 42, hasp 34 is rotated to its lower position so that pin channels 50, 86 are aligned with one another. Pin 36 is then inserted through pin channel 86 formed in hasp 34 into pin channel 50 formed in lower portion 66 of forward portion 62 of body 44 so as to compress spring 60. When bolt 38 is normally spring-biased to its lock position, insertion of pin 36 into pin channel 50 causes bolt 38 to retract somewhat until bolt 38 is exposed to notch 100 at which point bolt 38 enters notch 100 so as to block withdrawal of pin 36 from pin channel 50. When bolt 38 is normally spring-biased to its unlock position, entry of the predetermined code into user input device 110 by user 112 causes controller 30 to generate the output signal on wiring 106 so that actuator 40 moves bolt 38 to its lock position into notch 100. Pin 36 blocks upward rotation of hasp 34 when bolt 38 blocks withdrawal of pin 36 from pin channel 50 so that hasp 34 thereby retains handle 14 in handle space 42.

To unlock handle 14, user 112 inputs the predetermined code into user input device 110, as shown, for example, in FIG. 6. When bolt 38 is normally spring-biased to its lock position, entry of the code causes the controller 30 to generate the output signal on wiring 40 so that actuator 40 causes bolt 38 to move to its unlock position. When bolt 38 is normally spring-biased to its unlock position, entry of the code causes the controller 30 to stop generating the output signal on wiring 40 so that bolt 38 can return to its unlock position, as shown, for example, in FIG. 7. Once bolt 38 is moved to its unlock position, spring 60 moves pin 36 upwardly to facilitate user access to pin 36 and user 112 pulls on pulls tab 102 so as to withdraw pin 36 from pin channels 50, 86 (or at least from pin channel 50), as shown, for example, in FIG. 7. Hasp 34 is then rotated upwardly to allow withdrawal of handle 14 from handle space 42, as shown, for example, in FIG. 8.

The invention claimed is:

1. An apparatus comprising a trailer comprising a door and a door latch for latching the door in a closed position, the door latch comprising a handle movable to latch and unlatch the door, and a handle lock comprising (i) a housing comprising a one-piece metal casting and a back plate, the casting extending through the door, the back plate being coupled to the casting to cover an opening into the casting and engaging a rear surface of the door to block withdrawal of the casting from the door, (ii) a hasp positioned in front of the door and coupled to the casting for rotation relative thereto, (iii) a pin extendable through the hasp into the casting to block rotation of the hasp, (iv) a bolt positioned in the casting, and (v) a bolt actuator positioned in the casting for moving the bolt relative to the pin between a lock position blocking withdrawal of the pin from the casting so that engagement between the pin and the hasp blocks rotation of the hasp to lock the handle in a handle space located between the hasp and the casting for locking the door in the closed position and an unlock position allowing withdrawal of the pin from the casting so that the hasp can be rotated to allow withdrawal of the handle from the handle space and unlatching of the door.

2. The apparatus of claim 1, wherein the casting comprises an actuator chamber in which the bolt actuator is positioned, a pin channel for receiving the pin, and a bolt channel interconnecting the actuator chamber and the pin channel for movement of the bolt in the bolt channel to engage and disengage the pin.

3. The apparatus of claim 2, wherein the handle lock comprises a spring positioned in the pin channel for at least partially ejecting the pin from the pin channel when the bolt releases the pin due to movement of the bolt from the lock position to the unlock position.

4. The apparatus of claim 2, wherein the casting comprises a drain channel extending from the pin channel to an external surface of the casting to drain liquid from the pin channel.

5. The apparatus of claim 2, wherein the casting comprises a forward portion positioned in front of the door and a sleeve extending from the forward portion through a through-hole formed in the door to a location adjacent the back plate, the forward portion comprises the pin channel and the bolt channel, and the actuator chamber is formed in the sleeve between the forward portion and the back plate.

6. The apparatus of claim 5, wherein the handle lock comprises a plurality of fasteners, the casting comprises a plurality of fastener receivers positioned in the actuator chamber, and the fasteners extend through the back plate into the fastener receivers.

7. The apparatus of claim 5, wherein the forward portion comprises a wall, a lower portion, and a retainer flange, the wall extends upwardly from the lower portion, is positioned between the hasp and the sleeve, and is coupled to the sleeve, the lower portion is positioned below the hasp and comprises the pin channel; the bolt channel, and a curved external contour, the retainer flange extends around the wall and the lower portion and engages a front surface of the door to block withdrawal of the casting from the through-hole formed in the door, and the handle lock comprises a hasp mount that is coupled to the hasp and extends through the wall.

8. The apparatus of claim 1, wherein the hasp and the pin comprise curved external contours that match one another when the pin extends through the hasp into the casting and is retained by the bolt.

9. The apparatus of claim 8, wherein the pin comprises a pull tab coupled to the curved external contour of the pin for withdrawing the pin from the casting.

10. The apparatus of claim 1, wherein the casting comprises a retainer flange engaging a front surface of the door to block withdrawal of the casting from the door.

11. The apparatus of claim 1, wherein the handle lock comprises a controller coupled to the door and electrically coupled to the bolt actuator to control operation of the bolt actuator and thus movement of the bolt, and the controller comprises a user input device for receiving an input from a user.

12. The apparatus of claim 11, wherein the handle lock comprises wiring extending from the controller through the housing to the bolt actuator.

13. A handle lock for use with a trailer comprising a door and a door latch for latching the door in a closed position, the door latch comprising a handle movable to latch and unlatch the door, the handle lock comprising a housing comprising a one-piece body and a back plate, the body being configured to be mounted in a through-hole formed in the door for access to the body in front of the door, the back plate being coupled to the body to engage a rear surface of the door to block withdrawal of the body from the door, a hasp coupled to the body for rotation relative thereto, a pin extendable through the hasp into the body to block rotation of the hasp, a bolt positioned in the body, and a bolt actuator positioned in the body for moving the bolt relative to the pin between a lock position blocking withdrawal of the pin from the body so that engagement between the pin and the hasp blocks rotation of the hasp to lock the handle in a handle space located between the hasp and the body for locking the door in the closed position and an unlock position allowing withdrawal of the pin from the body so that the hasp can be rotated to allow withdrawal of the handle from the handle space and unlatching of the door.

14. The handle lock of claim 13, wherein the hasp comprises a first pin channel for receiving the pin, and the body comprises an actuator chamber in which the bolt actuator is positioned, a second pin channel for receiving the pin, and a bolt channel interconnecting the actuator chamber and the second pin channel for movement of the bolt in the bolt channel to engage and disengage the pin.

15. The handle lock of claim 14, wherein the body comprises a forward portion configured to be positioned in front of the door and an intermediate portion coupled to the forward portion and the back plate and configured to be positioned in the through-hole formed in the door, the forward portion comprises the second pin channel and the bolt channel, and the intermediate portion comprises the actuator chamber which is positioned between the forward portion and the back plate.

16. The handle lock of claim 13, wherein the body comprises a retainer configured to engage a front surface of the door to block withdrawal of the body from the door.

17. The handle lock of claim 13, wherein the pin comprises a notch for receiving the bolt.

18. The handle lock of claim 13, comprising a controller, wherein the bolt actuator is a solenoid actuator coupled to the body, and the controller is configured to be coupled to the door and is electrically coupled to the solenoid actuator to control operation of the solenoid actuator and thus movement of the bolt.

19. A handle lock for use with a trailer comprising a door and a door latch for latching the door in a closed position, the door latch comprising a handle movable to latch and unlatch the door, the handle lock comprising a housing configured to be mounted in and extend through a through-hole formed in the door for access to the housing in front of the door, a hasp coupled to the housing for rotation relative thereto, a pin extendable through the hasp into the housing to block rotation of the hasp, a bolt positioned in the housing, and a bolt actuator positioned in the housing for moving the bolt relative to the pin between a lock position blocking withdrawal of the pin from the housing so that engagement between the pin and the hasp blocks rotation of the hasp to lock the handle in a handle space located between the hasp and the housing for locking the door in the closed position and an unlock position allowing withdrawal of the pin from the housing so that the hasp can be rotated to allow withdrawal of the handle from the handle space and unlatching of the door.

20. The handle lock of claim 19, wherein the housing comprises a metal casting configured to engage a front surface of the door and to extend into a through-hole formed in the door and a back plate coupled to the metal casting and configured to engage a rear surface of the door, the bolt and the bolt actuator are positioned in the metal casting, and the pin is extendable into the metal casting for engagement with the bolt.

* * * * *